US008851804B2

(12) United States Patent
Hussey et al.

(10) Patent No.: US 8,851,804 B2
(45) Date of Patent: Oct. 7, 2014

(54) PUMPABLE SUPPORT WITH CLADDING

(75) Inventors: David A. Hussey, Glenwood Springs, CO (US); Stephen G. Sawyer, McMurray, PA (US); George A. Watson, Prosperity, PA (US)

(73) Assignee: Micon, Glassport, PA (US)

( * ) Notice: Subject to any disclaimer, the term of this patent is extended or adjusted under 35 U.S.C. 154(b) by 42 days.

(21) Appl. No.: 13/091,849

(22) Filed: Apr. 21, 2011

(65) Prior Publication Data

US 2011/0262231 A1 Oct. 27, 2011

Related U.S. Application Data

(60) Provisional application No. 61/326,847, filed on Apr. 22, 2010.

(51) Int. Cl.
*E21D 15/00* (2006.01)
*E21D 15/48* (2006.01)

(52) U.S. Cl.
CPC ..... *E21D 15/483* (2013.01)
USPC ..... 405/288; 405/251; 405/289; 248/354.2

(58) Field of Classification Search
CPC ..... E21D 15/02; E21D 15/483; E21D 5/523
USPC ..... 405/288, 289, 251; 299/11, 12; 248/354.1, 354.2
See application file for complete search history.

(56) References Cited

U.S. PATENT DOCUMENTS 262,569 A * 8/1882 Case ..... 405/251
3,160,312 A * 12/1964 Johnston ..... 220/619
3,272,671 A * 9/1966 Gaylord et al. ..... 156/86
3,423,009 A * 1/1969 Palmer ..... 229/199
3,949,877 A 4/1976 Santoni
4,167,361 A * 9/1979 Petro et al. ..... 405/290
4,195,111 A 3/1980 Rautenbach
4,497,597 A * 2/1985 Chlumecky ..... 405/288
4,983,077 A * 1/1991 Sorge et al. ..... 405/288
5,308,196 A * 5/1994 Frederick ..... 405/288

(Continued)

OTHER PUBLICATIONS

Barczak, "An Overview of Standing Roof Support Practices and Developments in the United States", Mar. 25, 2006.

(Continued)

*Primary Examiner* — Benjamin Fiorello
*Assistant Examiner* — Stacy Warren
(74) *Attorney, Agent, or Firm* — McNees Wallace & Nurick LLC

(57) ABSTRACT

A support for use in mines and other underground workings is provided comprising a flexible inflatable bag configured for receiving a pumpable load-bearing material. A reinforcing material is provided for supporting the bag when the bag is filled with the load-bearing material. The reinforcing material can include reinforcing plates, rings, bands or barrels positioned about the outer periphery of the bag. Alternatively, the support can be formed from a plurality of stackable barrels that are filled with load-bearing material but without the inflatable bag. The barrels can include internal reinforcing or cladding material at spaced locations along the barrels to define controlled deflection zones. According to another design, the support can be designed to be extensible. The support is inexpensive to transport, can be erected on-site and has a reinforced structure with residual yield strength. A method for supporting a mine or other underground workings is disclosed.

18 Claims, 8 Drawing Sheets

(56) References Cited

U.S. PATENT DOCUMENTS

| | | | | |
|---|---|---|---|---|
| 5,823,671 | A * | 10/1998 | Mitchell et al. | 366/268 |
| 5,823,718 | A | 10/1998 | Du Plessis | |
| 6,079,910 | A * | 6/2000 | Marianski et al. | 405/288 |
| 6,196,635 | B1 * | 3/2001 | Rohaly et al. | 299/11 |
| 6,394,707 | B1 * | 5/2002 | Kennedy et al. | 405/288 |
| 6,547,492 | B1 | 4/2003 | Degville | |
| 7,097,389 | B1 * | 8/2006 | Skidmore et al. | 405/288 |
| 7,232,103 | B2 * | 6/2007 | Heath | 248/631 |
| 8,021,083 | B2 * | 9/2011 | Skarbovig | 405/288 |
| 8,246,276 | B2 * | 8/2012 | Bower et al. | 405/289 |
| 2008/0063479 | A1 * | 3/2008 | Stroyer | 405/244 |

OTHER PUBLICATIONS

Barczak, "Updating the NIOSH Support Technology Optimization Program (STOP) with New Support Technologies and Additional Design Features", Apr. 19, 2004.

Barczak et al., "Pumpable Roof Supports: An Evolution in Longwall Roof Support Technology", May 22, 2008.

* cited by examiner

PUMPABLE SUPPORT WITH CLADDING

CROSS REFERENCE TO RELATED APPLICATION

This application is based upon U.S. Provisional Patent Application Ser. No. 61/326,847 entitled "Pumpable Support with Cladding", filed Apr. 22, 2010, which is hereby incorporated by reference.

BACKGROUND OF THE INVENTION

1. Field of the Invention

The present invention relates generally to a mine roof support and, more particularly, to a pumpable mine roof support which is inexpensive to transport, can be erected on-site and has a reinforced structure with residual yield strength.

2. Description of Related Art

Various roof support devices in the prior art have been designed and used to provide support to a mine roof. Deep mining results in removal of material from the interior of a mine, thereby leaving unsupported voids of various sizes within the mine. These unsupported voids are conducive to mine roof buckling and/or collapse. Thus, it has been desirable to provide support to mine roofs to prevent, delay, or control collapse thereof.

Longwall shield systems are often used to prop up a roof during mining/tunneling. Some current systems use hydraulic rams which can adjust the height of the loading point against the roof. This type of system can adjust according to a certain amount of pressure from above with a desired yield of hydraulic fluid. However, when the load becomes too heavy, the hydraulic ram loading point can puncture through the roof. These shields are typically positioned on the active coal mining face. Supplemental roof supports are typically located in the tailgate roadway between longwall panels. The reason for the supplemental roof supports is to keep the tailgate open. The side weight from the last mined panel and the forward abutment weight from the active longwall panel can crush the tailgate closed, which blocks the airway needed to carry away dust and gas.

U.S. Pat. No. 5,308,196 to Frederick discloses another type of prior art mine roof support. Specifically, the Frederick patent discloses a confined core mine roof support including a container and compressible filler placed within the container. Installation of the roof support requires use of wood footing material at the base and top of the roof. The footing material is used to fill any remaining voids between the top of the roof support and the mine roof.

The use of wood as the footing material has numerous disadvantages. For example, the use of wood as the footing material causes the footing material to be susceptible to rot or other damage, which, over time, will lessen the structural integrity thereof and overall safety of the mine roof support installation. Additionally, since the remaining void between the top of the roof support and the mine roof is variable, correspondingly-sized footing material is required for each and every installation of the prior art mine roof support. Collecting and appropriately sizing the footing material for use in each installation is time consuming. Furthermore, timber for use as the footing material is relatively expensive. Also, due to the fact that the wood footing material may not necessarily be engineered, there is an inherent uncertainty and risk associated with the load capacity attributed to each piece of wood footing material. Specifically, each piece of wood footing material may absorb a varying amount of compressive force. Thus, there is a need to perform scheduled monitoring of each roof support installation to ensure that the wood footing material has completely settled and remains in compressed contact with the mine roof. Thereafter, additional wood footing material (e.g., wedges) may be necessary.

Another type of mine roof support comprises a Can support. This type of support is known for its stability and high yield performance and can provide support capacities ranging from 60 to 200 tons per support unit. The Can support also performs well in both high mining heights and high deformation environments that include 2-3 feet of floor heave that produces large lateral displacement of the base of the Can relative to the roof contact. FIG. 1 shows an example of a Can support 10 which is laterally displaced with respect to a roof 12 and floor 14 of the mine. The Can support has several disadvantages. One disadvantage is that it has to be topped off to establish roof contact and transportation difficulties due to its bulky size, particularly in lower seam operations. Normally, the support is topped off with wood crib timbers; however, this softer timber material can significantly degrade the stiffness of the support and stability if not properly installed. Another disadvantage of the Can support is that, once a certain load threshold is exceeded, the Can support can puncture through the roof. Yet another disadvantage of the Can support is that, after a certain degree of lateral displacement is exceeded, the one-piece Can support can tip over.

Yet another type of mine support was first developed in the United States by MICON, the Assignee of the present invention, in the early 1980's as an emergency action to help support a deteriorated longwall tailgate return airway that was collapsing. The supports included slip forms that were filled with pumpable material from the floor up to the roof in multiple lifts. The shapes of the bags were square, rectangular, and eventually round. Another type of pumpable mine support has been developed by Heitech (part of Heintzmann Corporation) and shown in FIG. 2, wherein pumpable load-bearing material is pumped into a fabric bag 20 hung from a mine roof 22. The pumpable load-bearing material is transported through tubular members 26 within the mine and through an opening 28 in the bag 20. While this fabric bag 20 provides a structure to form the support and provides confinement to the load-bearing material, this pumpable support sheds considerable load during post peak support. This is because the fabric bag 20 does not have the rigidity of the steel Can support and cannot provide sufficient confinement to prevent this load shedding. A residual load of up to 200 tons can be maintained through several inches, however, the pumpable bag arrangement will not have the residual strength of a Can support. Also, once a certain load threshold is exceeded, the pumpable material can bulge against the bag.

U.S. Pat. No. 6,547,492 to Degville discloses an inflatable mine support comprising a steel tube, which is installed where it is desired, to provide support and a flexible bag located within the tube for receiving pumpable load-bearing material. This arrangement allows for adjustability of the support in that the bag conforms to irregularities in the roof and floor, eliminating the need for topping off with respect to the roof and floor surface. Also, this arrangement allows for inflation on site. However, this arrangement also has the disadvantage of the Can support in that it is contained within a steel tube and, thus, may not have the necessary residual yield capacity to avoid punching through the roof if subjected to a significant load.

U.S. Pat. No. 6,394,707 to Kennedy et al., entitled "Yieldable Mine Roof Support", utilizes a telescoping, cylindrical, metal container into which a filler material is installed on site. The telescoping feature of this support assures direct contact of the support with the mine roof and floor, eliminating the need for wood cribbing. The shortcoming of this support is that the metal cylinder, which can provide half or more of the strength of the roof support, is not continuous from roof to floor. This support has an "oversized", metal cylinder sliding upward from and over a smaller diameter, metal cylinder as the filler material is installed. Thus, the load capacity of this roof support is dependent on the strength of the filler material, which reaches its peak after an inch convergence, and achieves no strength from the vertical compression of the metal cylinders. Supplementary roof supports must sustain minimum loads from 100 to 200 tons for deflections up to 10 inches and beyond, and it would seem that this support could not perform as needed in an underground mine.

Cribs are required to provide a peak strength (e.g., 300,000 lbs.) above an initial amount of compression (e.g., 1 inch) and then a residual strength (e.g., 200,000 lbs.) over a subsequent, extended range of compression (e.g., 1-6 inches). The specification of peak strength, residual strength, and the compression range are functions of mine conditions, amount of overburden, type of roof and floor material, and the like. A mining engineer specifies particular performance standards based upon a particular environment of use for which a crib must function as a load-carrying structure from its elastic to plastic range. The crib manufacturer/installer is then assigned the task of producing and/or installing a crib which meets these performance standards. Accordingly, there is a need in the art for a mine support which can be easily/quickly constructed and/or tailored in an economic manner to satisfy a myriad of mine conditions.

SUMMARY OF THE INVENTION

Accordingly, the present invention overcomes many of the disadvantages of the prior art in that it is easy to transport and can be erected and filled on site using variable-sized segments, while providing a support that has sufficient load-bearing capabilities, while allowing for residual yield strength to avoid penetration into the roof. The present invention also allows one to quickly and economically construct a mine support/crib to satisfy a set of performance standards that can widely vary depending upon a certain set of mine conditions. Additionally, because reinforcing material is provided about the periphery of the support, the strength requirements of the pumpable material become less important. Hence, less expensive pumpable filling materials can be used, enhancing the economic advantages of the support of the present invention.

According to a first aspect, the invention is directed to a support for use in mines and other underground workings, comprising a flexible inflatable or Tillable bag having a top portion, a bottom portion, and a cylindrical sidewall extending between the top portion and the bottom portion. The bottom portion can be multiple-added sections of various sizes tailored to a specific condition, including the height of the mine opening and the anticipated load. An inlet is provided that extends through either the top portion or a top portion of the sidewall for admission of a pumpable load-bearing material. A reinforcing material is provided for supporting the flexible inflatable bag when the bag is filled and inflated with the load-bearing material. The support is inexpensive to produce, easy to transport, and can be erected/filled in position within the mine. The pumpable load-bearing material can comprise a two-component, quick setting grout material or any combination of cement, rock dust, salt, sand, coal, rock waste, and the like. The reinforcing material can be positioned adjacent the cylindrical sidewall of the bag.

According to one embodiment, the reinforcing material can be cladding that is positioned about an outer periphery of the cylindrical sidewall of the bag. The cladding can be one or more reinforcing plates that surround at least a portion of the cylindrical sidewall of the bag. The reinforcing plates can be formed from one or more combinations of steel, wood, plastic, fiber-reinforced composite, and the like. A plurality of bands can be provided to wrap about the outer periphery of the cylindrical sidewall of the bag for holding the at least one reinforcing plate in position. These bands can be selected from steel, plastic, cable, combinations thereof, and the like. According to one design, the reinforcing material can comprise a plurality of load-bearing bands wrapped directly about the outer periphery of the cylindrical sidewall of the bag, (i.e., without the reinforcing plates). These bands can be thicker than those used for holding the plates about the bag sidewall. These bands can also be steel, plastic, cable, and the like, and/or any combination thereof.

In another embodiment, the reinforcing material can comprise a plurality of stackable drums. The stackable drums can be any variety of heights, as long as their diameters are comparable with one another to allow for stacking. According to one design, the plurality of drums can comprise 55 gallon drums secured together by a securing member, such as reinforcing rings, bands, ties, and any combination thereof.

According to another aspect, the invention is directed to a method of supporting a mine or other underground workings comprising positioning a flexible inflatable bag or fillable bag below a roof of a mine or underground working. The flexible inflatable bag has a top portion, a bottom portion, and a cylindrical sidewall extending between the top portion and the bottom portion. An inlet can be provided that extends through either the top portion or the top portion of the sidewall of the flexible inflatable bag. The method further includes injecting a pumpable load-bearing material through the inlet to fill the bag until the top portion contacts and supports the roof and providing a reinforcing material for providing support to the flexible inflatable bag when the bag is filled and inflated with the load-bearing material. The reinforcing material can be selected from the group consisting of plates, reinforcing bands, drums, and the like. According to one embodiment, this reinforcing material can be a cladding that is positioned about the outer periphery of the sidewall of the bag.

According to another aspect, the invention is directed to a support for use in mines and other underground workings comprising at least two stacked cylindrical drums, wherein the stacked cylindrical drums include a top portion, a bottom portion wherein the bottom portion can be multiple added sections of various sizes, and a cylindrical sidewall extending between the top portion and the bottom portion. An opening is provided that extends through the top portion of the stacked cylindrical drums for receiving a load-bearing material therethrough. At least one securing member is provided for securing the at least two stacked cylindrical drums.

According to another aspect, the invention is directed to a support for use in mines and other underground workings comprising at least one cylindrical member having a top portion, a bottom portion, and a cylindrical sidewall extending between the top portion and the bottom portion. An opening extends through the top portion of the at least one cylindrical member which is configured for receiving a load-bearing material therein. At least two reinforcing members are associated with the at least one cylindrical member for providing support to the cylindrical member. The at least two reinforcing members are spaced a distance apart with respect to the sidewall of the at least one cylindrical member to define a controlled deflection zone. This controlled deflection zone is configured for controlled deflection of the sidewall upon an application of a load to the support and/or upon a shifting of the load-bearing material contained within the at least one cylindrical member. According to one design, the at least one cylindrical member can comprise a plurality of stackable cylindrical members, such as two 55 gallon drums stacked upon one another. According to one embodiment, the at least two reinforcing members can be three reinforcing members comprising a top reinforcing member, a bottom reinforcing member, and a central reinforcing member located between adjacently stacked drums. Additional multiple sized sections may be needed due to height variations of the cylindrical members and/or mine opening. The reinforcing members can comprise cylindrical internal cladding members, such as sectioned cylindrical 55 gallon drums, positioned at spaced locations adjacent to an inner surface of the sidewall of the cylindrical member. When using two 55 gallon drums stacked upon one another, the support will include at least two controlled deflection zones. Each of these controlled deflection zones is capable of absorbing multiple inches of deflection according to the design engineer's recommendation for expected deflection. According to one embodiment, this controlled deflection zone is capable of absorbing up to 12 inches of deflection.

According to yet a further aspect, the support can include a yield ring associated with the top portion of the at least one cylindrical member. This yield ring can comprise a plurality of separate load-bearing members banded together. The yield ring can be used in place of wood footing material that was previously used to fill any remaining voids between the top of the roof support and the mine roof. The plurality of separate load-bearing members can be custom sized for different mining heights and can be filled to achieve a specified density. A load transfer plate can be positioned between the yield ring and the top portion of the at least one cylindrical member.

According to another aspect, the invention is directed to a method of supporting a mine or other underground workings. The method includes providing at least one cylindrical member having a top portion, a bottom portion, and a cylindrical sidewall extending between the top portion and the bottom portion. The top portion includes an opening extending therethrough and is configured for receiving a load-bearing material therein. The method further includes associating at least two reinforcing members, with the at least one cylindrical member for providing support to the cylindrical member. The at least two reinforcing members can be spaced a distance apart with respect to the sidewall of the at least one cylindrical member to define a controlled deflection zone of the sidewall. This controlled deflection zone is configured for controlled deflection of the sidewall upon an application of a load to the support and/or upon a shifting of the load-bearing material contained within the at least one cylindrical member. According to one design, the at least one cylindrical member can comprise a first drum and a second drum, and the at least two reinforcing members can comprise at least three reinforcing members. The reinforcing members can be formed by sectioning a drum to form a top reinforcing member, a bottom reinforcing member, and a central reinforcing member. These reinforcing members are configured for use as internal cladding members positioned at spaced locations adjacent to an inner surface of the first and second drums. According to the method, the first and second drums are stacked adjacent to each other and the top reinforcing member is located at a top portion of the first drum, the bottom reinforcing member is located at a bottom portion of the second drum, and the central reinforcing member is located between the adjacently stacked drums. According to a further aspect, a load transfer plate can be positioned adjacent to the top portion of the at least one cylindrical member, and a yield ring comprising a plurality of separate load-bearing members can be positioned adjacent to the load transfer plate.

According to yet another aspect, the invention is directed to an extensible mine roof support that includes a container member and a support member movably received within the container member. The container member includes a bottom portion and a side portion upwardly extending from the bottom portion. The support member is sized to be received within the container member. The support member defines an enclosure for receiving a filler therein. Exemplary fillers include, but are not limited to, foam cement, concrete, or crushed mine tailings or fly ash. A bore, defined within the support member, includes a first opening defined along a side portion of the support member and a second opening defined along a bottom portion of the support member. The bore is sized to receive material therethrough such that the material delivered into the first opening is deposited via the second opening into the container member, such that the deposited material urges the support member into contact with the mine roof. Exemplary material includes, but is not limited to, sand, polyurethane foam, or pea gravel. Desirably, the container member and the support member are both substantially cylindrical in shape.

According to still a further aspect, the invention is directed to a method of supporting a mine roof including positioning the container member below the mine roof. Thereafter, the support member is inserted into the container member. Then material is delivered through the first opening of the bore hole or from a place strategically positioned to service that portion of the complex, such that the material is deposited via the second opening into the container member. Consequently, as more material is deposited into the container member, the support member is increasingly moved closer to the mine roof. Once the support member contacts the mine roof, the weight of the mine roof is supported on the mine roof support of the present invention.

Still other desirable features of the invention will become apparent to those of ordinary skill in the art upon reading and understanding the following detailed description, taken with the accompanying drawings, wherein like reference numerals represent like elements throughout.

DETAILED DESCRIPTION OF THE INVENTION

Figure 1:
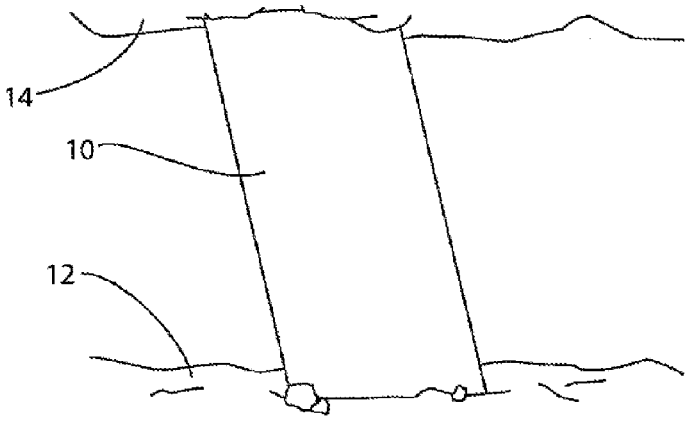
PRIOR ART FIG. 1
FIG. 1 is a perspective view of a Can support according to the prior art.
Figure 2:
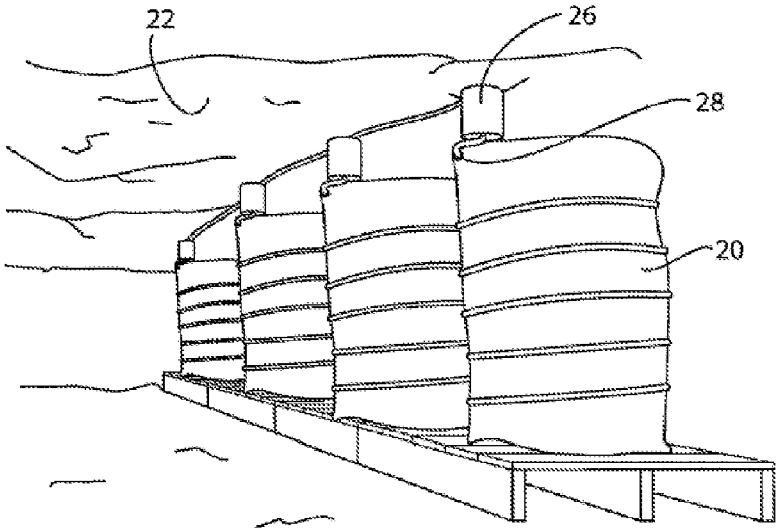
PRIOR ART FIG. 2
FIG. 2 is a perspective view of pumpable fabric filled supports according to the prior art.

For purposes of the description hereinafter, spatial or directional terms shall relate to the invention as it is oriented in the drawing figures. However, it is to be understood that the invention may assume various alternative variations except where expressly specified to the contrary. It is also to be understood that the specific apparatus illustrated in the attached drawings, and described in the following specification, is simply an exemplary embodiment of the invention. Hence, specific dimensions and other physical characteristics related to the embodiments disclosed herein are not to be considered as limiting, unless otherwise indicated.

Reference is now made to FIGS. 3A, 3B, 4, and 5A which show a support, generally indicated as 100, 200 for use in mines and other underground workings. The support 100, 200 comprises a flexible inflatable bag 110, 210 (210 being shown in phantom in FIG. 5A) having a top portion 112, 212; a bottom portion 114, 214; and a cylindrical sidewall 116, 216 extending between the top portion 112, 212 and the bottom portion 114, 214. An inlet, generally indicated as 120, 220, is provided that extends through either the top portion 112, 212 or a top portion 122 of the sidewall 116, 216 for admission of a pumpable load-bearing material 130, 230. A reinforcing material 140, 142, 150, 260 is provided for supporting the flexible inflatable bag 110, 210 when the bag is filled and inflated with the load-bearing material 130, 230. The pumpable load-bearing material 130, 230 can comprise a two-component, quick-setting grout material, as discussed in more detail below. Alternative load-bearing materials include any combination of foamed cement (such as FOAMCRETE®), cement, rock dust, salt, sand, coal, rock waste, and the like. The load-bearing material 130, 230 can also be crushed mine tailings (i.e., discarded excavated mine material) which can be removed at the mine site and fed directly into the inflatable bag 110, 210. The reinforcing material 140, 142, 150, 260 can be positioned adjacent the cylindrical sidewall 116, 216 of the inflatable bag 110, 210.

The inflatable bag 110, 210 can be made from a stretchable or nonstretchable material, such as a non porous fabric, such as a polyvinyl chloride. Other suitable materials for the bag 110, 210 include polyamide and polyethylene, (e.g., a low density polyethylene having a thickness of substantially at least 5 mil., preferably 7 to 15 mil.). The use of polyamide as the bag material allows for the use of a thinner sheet of approximately at least 2.5 mil., preferably about 3 to 5 mil. Yet another type of material for the bag 110, 210 includes MSHA (Mine Safety and Health Administration) approved jute, woven in strips of webbing in opposing directions to assist in its self-supporting function to handle the liquid or solid materials being pumped into them, while hanging from the mine roof. These bags can also be made to fit inside already existing wooden cribs in place to increase their strength by slipping the bag inside the crib and filling it to the mine roof. This process would prevent the wooden crib structure from rolling or moving. The bag must be capable of withstanding the superatmospheric pressure which results from the introduction of the pumpable load-bearing material. The inflatable bag 110, 210 is such that, upon filling with the load-bearing material, it can conform to the mine roof and mine floor, eliminating the need for wood timber supports or other types of supports.

The top portion 112, 212 of the inflatable bag 110, 210 of the present invention can include a rubber material incorporated into the matrix of the inflatable bag 110, 210 or at the bottom 114, 214 of the inflatable bag 110, 210, which can be determined by the expected mining conditions, to create a footing having an expanded diameter, (i.e., an elephant-type footing). This expanded diameter footing will help stabilize the support during extreme weight shifts to keep the main portion of the inflatable bag 110, 210 intact to finish its intended job, and leave a much more stable unit that will not punch into the mine floor or mine roof.

As stated above, one example of the load-bearing material that can be used is a settable material, such as a cementitious grout. Suitable grouts include TekCem® and TekBent® available from Minova USA, Inc. of Georgetown, Ky. The grout may be one known in the art as a high yield grout, that is of high water content, for example a ratio by weight of water:powder of 1:1 to 4:1. The grout may be a fast setting grout, such as various blends of cement mixes.

It can be appreciated that the use of the strength-enhancing reinforcing material 140, 142, 150, 260 positioned about the periphery of the inflatable bag 110, 210 reduces the importance of the strength properties of the load-bearing material 130, 230. Hence, the more expensive pumpable materials used heretofore, can be replaced with less expensive load-bearing or filler material 130, 230. However, when determining the number, size, and types of reinforcing material to use for the support 100, 200, one must also consider the structural and/or geotechnical properties of the particular filler or support material so that the support satisfies a particular set of performance standards.

Figure 3A:
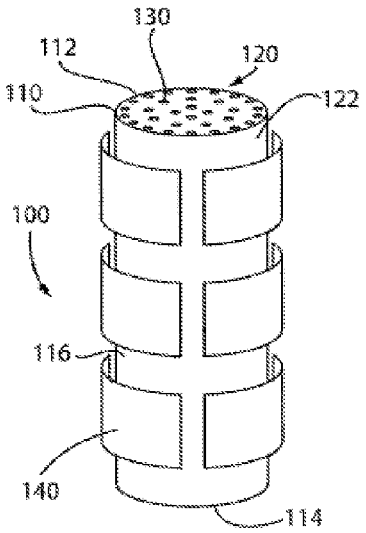
FIG. 3A is a partially expanded schematic side view of the support according to a first embodiment of the invention.
Figure 3B:
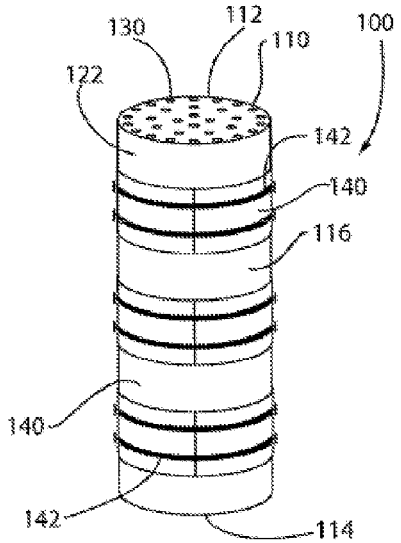
FIG. 3B is a schematic side view of the support of FIG. 3A in an assembled position.

According to one design, as shown in FIGS. 3A and 3B, the reinforcing material 140, 142 can be cladding in the form of one or more reinforcing plates 140 that are positioned about and surround an outer periphery of the cylindrical sidewall 116 of the bag 110. The reinforcing plates 140 can be formed from a material formed from one or more of a combination of steel, wood, plastic, fiber-reinforced composite, and the like. A plurality of bands 142 can be provided to wrap about the outer periphery of the cylindrical sidewall 116 of the bag 110 for holding the at least one reinforcing plate 140 in position. These bands 142 can be formed from steel, plastic, cable, combinations thereof, and the like. Examples of bands that can be used in the invention include steel bands, nylon cables, plastic zip ties, and other similar types of tying/banding material.

Figure 4:
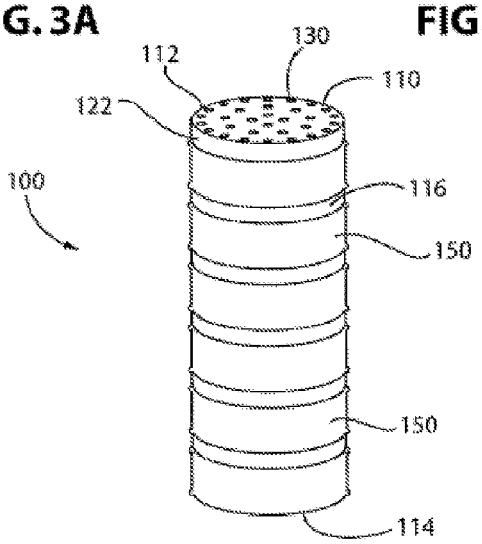
FIG. 4 is a schematic side view of the support of FIG. 3A using a load-bearing member according to a different design.

In a modified design, as shown in FIG. 4, the reinforcing material can comprise a plurality of load-bearing bands 150 wrapped directly about the outer periphery of the cylindrical sidewall 116 of the bag 110. In this design, the reinforcing plates 140 are eliminated. The bands 150 in this design are thicker than the bands 142 which are used for holding the plates 140 about the cylindrical sidewall 116, as discussed above in relation to the embodiment shown in FIGS. 3A and 3B. These bands can be formed from steel, plastic, cable, and the like, as long as the bands have sufficient strength to reinforce the support 100. Examples of bands that can be used in the invention include steel bands, nylon cables, plastic zip ties, and other similar types of tying/banding material. The selection of the number, sizes, and material make-up of the bands for a specified performance standard is based upon empirical formulae that is developed by extensive laboratory testing and analyses.

Adding to the complexity of designing a support and/or crib is that mine conditions can worsen after installation of the support. Prior to the present invention, these worsening conditions would require the installation of additional supports in these "problem" areas. The design flexibility of the present invention allows one to strengthen the supports already in place by the application of additional cladding material, (i.e., the application of additional plates 140 and/or reinforcing bands 150 about the support 100).

Figure 5A:
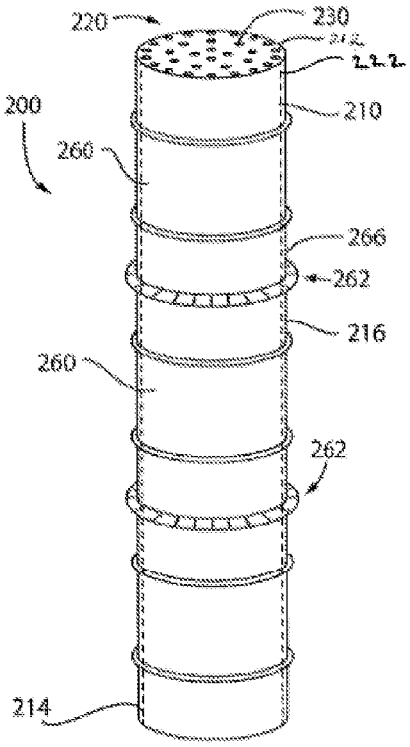
FIG. 5A is a schematic side view of the support according to a second embodiment of the invention.
Figure 5B:
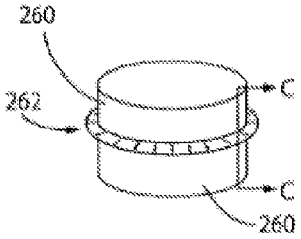
FIG. 5B is a partial view of the support of FIG. 5A.
Figure 5C:
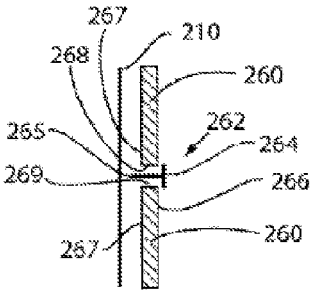
FIG. 5C is a cross-sectional view taken along line C-C of FIG. 5B.
Figure 5D:
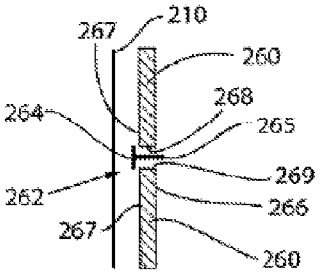
FIG. 5D is a cross-sectional view of the support of the second embodiment according to a modified design.

In yet another embodiment, as shown in FIGS. 5A, 5B, and 5C, there is shown a support, generally indicated as 200, wherein the reinforcing material can comprise a plurality of stackable drums 260, which can include the bag 210 for receiving the pumpable load-bearing material 230. The stackable drums 260 can be any variety of heights, as long as their diameters are comparable with one another to allow for stacking. According to one design, the plurality of drums 260 can comprise 55-gallon drums (typically two feet in diameter and three feet in height) secured together by a securing member 262, such as reinforcing rings, bands, ties, and any combination thereof. The securing member 262 can be an internal or external ring. FIG. 5C shows a cross-sectional view of an external ring 262, wherein the ring is T-shaped, including a cross portion 264 for contacting an outer surface 266 of the barrel 260 and an extending portion 265 that extends between and contacts a bottom surface 268 and top surface 269, respectively, of mating barrels 260. FIG. 5D shows an alternative internal ring design, wherein the cross portion 264 can contact an inner surface 267 of the barrel 260.

It can be appreciated that the barrels 260 may be used without a bag 210 and instead are pre-filled with a lightweight support material, such as foamed cement. Particularly when the barrels 260 are sized about one foot in height, the pre-filled barrels 260 may be readily transported into an underground mine and stacked in position using securing members 262 to provide a mine roof support.

According to another aspect, with continuing reference to FIGS. 3A, 3B, 4, and 5A, the invention is directed to a method of supporting mine or other underground workings comprising positioning a flexible inflatable bag 110, 210 below a roof of a mine or underground working. The flexible inflatable bag 110, 210 has a top portion 112, 212; a bottom portion 114, 214; and a cylindrical sidewall 116, 216 extending between the top portion 112, 212 and the bottom portion 114, 214. An inlet 120, 220 can be provided that extends through either the top portion 112, 212 or the top portion 122, 222 of the sidewall 116, 216 of the flexible inflatable bag 110, 210. The method further includes injecting a pumpable load-bearing material 130, 230 through the inlet 120, 220 to inflate the bag 110, 210 until the top portion 112, 212 contacts and supports the roof of the mine and providing a reinforcing material 140, 142, 150 and 260 for providing support to the flexible inflatable bag 110, 210 when the bag 110, 210 is filled and inflated with the load-bearing material 130, 230. The reinforcing material can be selected from the group consisting of plates/bands 140, 142, reinforcing bands 150, drums 260, and the like. According to one embodiment, as shown in FIGS. 3A and 3B, this reinforcing material can be a cladding that is positioned about the outer periphery of the sidewall 116 of the bag 110.

Figure 6:
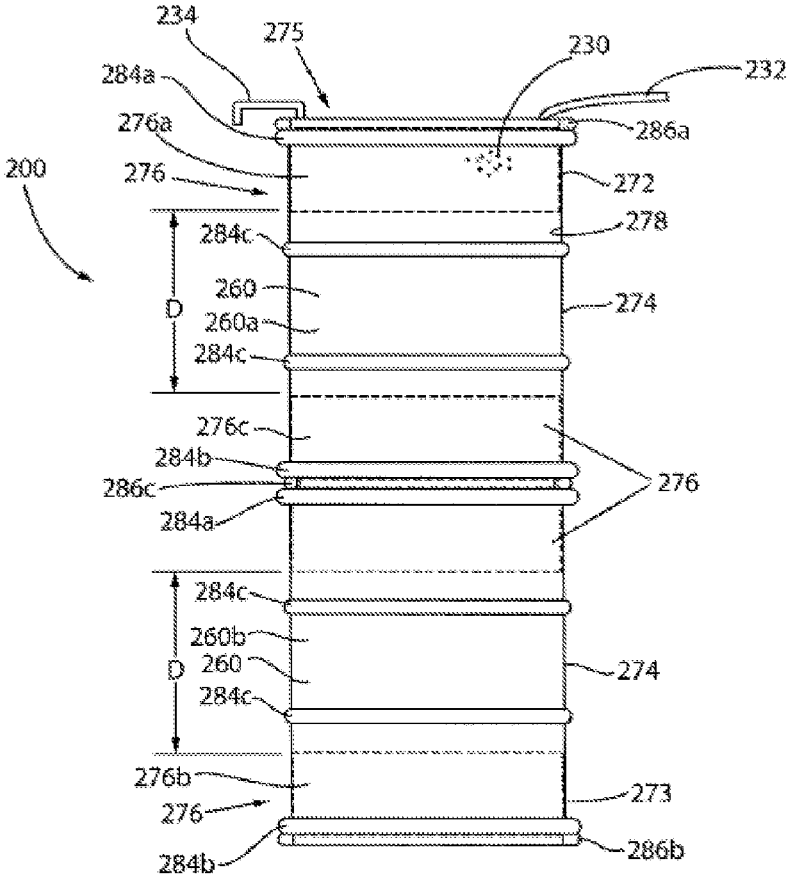
FIG. 6 is a side elevation view of the support according of FIG. 5A using a securing member according to a different design.
Figure 7:
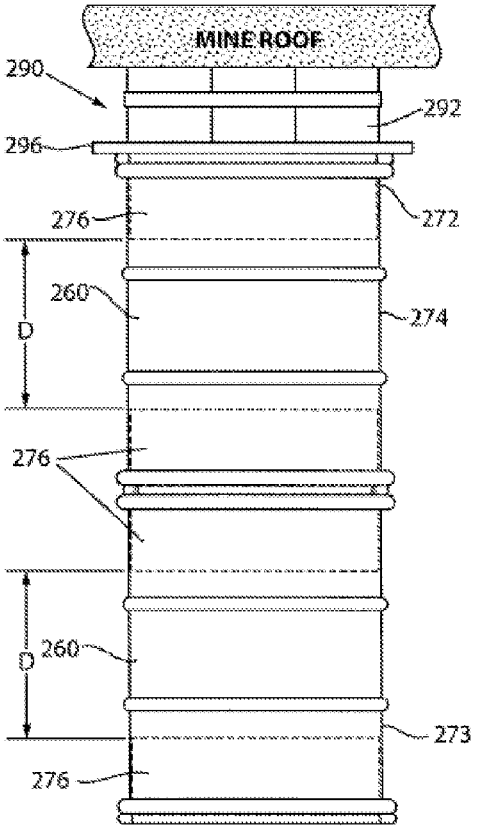
FIG. 7 is a side elevation view of the support of FIG. 6 including a yield ring according to a further design of the invention.

Reference is now made to FIGS. 6 and 7 which show a modified design of support 200 utilizing cylindrical members or stackable drums 260, as shown in FIG. 5A. This type of support 200 is capable of withstanding up to two hundred plus tons of force, are easily filled, economical to produce, and have high yielding capabilities. It can be appreciated that any number of cylindrical members or drums 260 may be used, depending upon the height of the mine opening. For example, in low seam mining, a single cylindrical member or drum 260 may be utilized. The at least one cylindrical member or drum 260 has a top portion 272, a bottom portion 273, and a cylindrical sidewall 274 extending between the top portion 272 and the bottom portion 273. An opening, generally indicated as 275, extends through the top portion 272 of the at least one cylindrical member 260. This opening 275 is configured for receiving the load-bearing material 230 fed via pump 232 therein. A vent or port 234 can be provided to allow for air to escape during filling of the cylindrical member 260 with the load-bearing material 230. At least two reinforcing members, generally indicated as 276, are associated with the at least one cylindrical member or drum 260 for providing support to the cylindrical member or drum 260. The at least two reinforcing members 276 are spaced a distance apart with respect to the cylindrical sidewall 274 of the at least one cylindrical member or drum 260 to define a controlled deflection zone "D". This controlled deflection zone "D" is configured for controlled deflection of the portion of the sidewall 274 within this zone "D" upon an application of a load to the support 200 and/or upon a shifting of the load-bearing material 230 contained within the at least one cylindrical member 200.

Figure 7A:
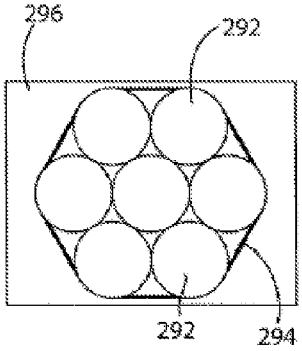
FIG. 7A is a top view of the yield ring shown in FIG. 6.

In the design shown in FIGS. 6, 7, and 7A, the at least one cylindrical member or drum 260 comprises a first drum 260*a* and a second drum 260*b*. According to one design, the at least one cylindrical member can comprise a plurality of stackable cylindrical members 260, such as two 55 gallon drums stacked upon one another. These types of drums 260 typically include a top welded rim or chime 284*a* and a bottom welded rim or chime 284*b*. Rolled or formed portions, often referred to as the drum ribs 284*c* can be provided along the sidewall 274 of the drum 260. It can be appreciated that these drums 260 can be new stock or can be re-used or re-furbished. The top and bottom of each drum 260 can be de-headed to make them stackable and to receive the reinforcing members 276. It has been found that the ductile nature of steel used in 55 gallon drums are capable of stretching a significant amount before failing. The stretching capability of the steel allows the drum skin to vertically fold over in the controlled deflection zones "D" and/or to bulge without tearing or rupturing when compressed. The "folding over" phenomenon can result in a three-wall thickness, which results in the addition of lateral strength while facilitating progressive yield at the same time, resulting in both yield relief and reinforcement in the same action. Although the use of 55 gallon drums have been described in detail above, it can be appreciated that drums or cylindrical members formed by materials or steels of various strengths can be used as long as these materials exhibit sufficient strength and yield characteristics to adequately support the mine roof under a predetermined load.

The at least two reinforcing members 276 can comprise at least three reinforcing members, such as a top reinforcing member 276*a*, a bottom reinforcing member 276*b*, and a central reinforcing member 276*c* located between adjacently stacked cylindrical members or drums 260. The reinforcing members 276*a*, 276*b*, and 276*c* can comprise cylindrical internal cladding members, such as internal cladding members that can be formed by sectioning a cylindrical 55 gallon drum into the top reinforcing member 276*a* having a top rim or top chime 286*a* intact, the bottom reinforcing member 276*b* having a bottom rim or bottom chime 286*b* intact, and the central reinforcing member 276*c* having a central rib 286*c*. The reinforcing members 276*a*, 276*b*, and 276*c* can be positioned at spaced locations adjacent an inner surface 278 of the sidewall 274 of the cylindrical members or drums 260. As shown in FIG. 6, the top reinforcing member 276*a* can be positioned within the first drum 260*a*, such that the top rim or top chime 286*a* is abutted against the top rim or chime 284*a* of the drum 260*a*. Also, the bottom reinforcing member 276*b* can be positioned within the second drum 260*b*, such that the bottom rim or the bottom chime 286*b* is abutted against the bottom rim or chime 284*b* of the drum 260*b*. These abutting rims or chimes provide double support to the top and bottom of the complete support structure 200. The central reinforcing member 276*c* can be located between the first drum 260*a* and the second drum 260*b*, such that the central rib 286*c* is positioned between and in abutting relationship with the bottom chime 284*b* of the first drum 260*a*, and top chime 284*a* of the second drum 260*b*, tripling the support at this location. Because both the cylindrical members or drums 260 and the reinforcing members 276 are formed from 55 gallon drums and thus, have the same diameter, the reinforcing members 276 form a tight fit within the cylindrical members or drums 260. It can be appreciated that the sectioned cylindrical 55 gallon drum can be new stock or it can be a re-used or re-furbished drum.

In the design that includes two 55 gallon drums stacked upon one another, the support will include at least two controlled deflection zones "D". Each of these controlled deflection zones "D" is capable of absorbing multiple inches of deflection, depending upon the design engineer's recommendation for expected deflection. According to one design, this controlled deflection zone is capable of absorbing up to 12 inches of deflection. The controlled deflection zones "D" are designed such that the cylindrical sidewall 274 of the drum 260 within this zone can either fold or crumple upon itself or, alternatively, stretch or bulge in an outward direction depending upon whether the filler material 230 shifts, moves, compacts, and/or pulverizes when subjected to a load. It can be appreciated that in one type of design, a single reinforcing member 276 can be provided within either the top or bottom of the cylindrical member or drum 260.

According to yet a further aspect, the support 200 can include a yield ring, generally indicated as 290, associated with the top portion 272 of the at least one cylindrical member 260. This yield ring 290 can comprise a plurality of separate load-bearing members 292 banded together. According to one embodiment, the separate load-bearing members 292 can comprise up to, and including, seven members banded together by a single band 294 formed from any known type of material, such as composite, metal, elastic, and the like, capable of withstanding the load and conditions within a mining environment. This particular design provides seven additional "skins" of reinforcement to the support 200. The separate load-bearing members 292 can receive the same type of reinforcing material 230 as the cylindrical members or drums 260. The yield ring 290 can be used in place of wood footing material that was previously used to fill any remaining voids between the top of the roof support 272 and the mine roof. The plurality of separate load-bearing members 292 can be custom sized for different mining heights and can be filled with various filler materials 230 to achieve a specified density. A load transfer plate 296, such as a steel skin, can be positioned between the yield ring 290 and the top portion 272 of the at least one cylindrical member or drum 260.

The support 100, 200 of the present invention has numerous advantages as it is inexpensive to produce, easy to transport, and can be erected and/or inflated in position within the mine.

It is to be understood that the mine roof support 100, 200 may be assembled remotely or on-site, or a combination thereof. Filling the inflatable bag 110, 210 or the support member 100, 200 itself on-site eliminates incurring costly and cumbersome heavy cargo accommodations that would ordinarily be necessary if each mine roof support 100, 200 is prefilled at a remote location.

Figure 8:
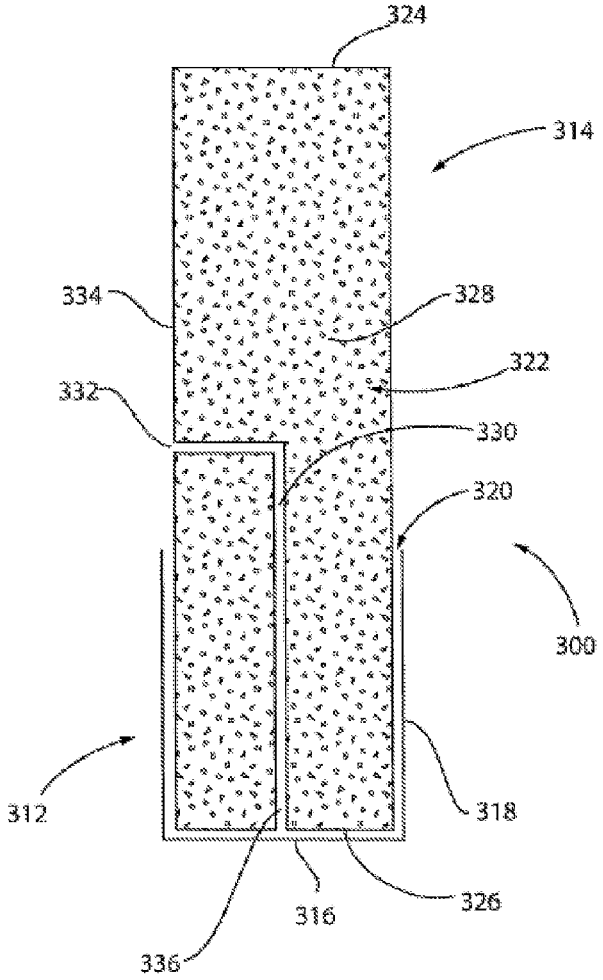
FIG. 8 is a cross-sectional view of an extensible mine roof support according to a third embodiment of the invention.
Figure 9:
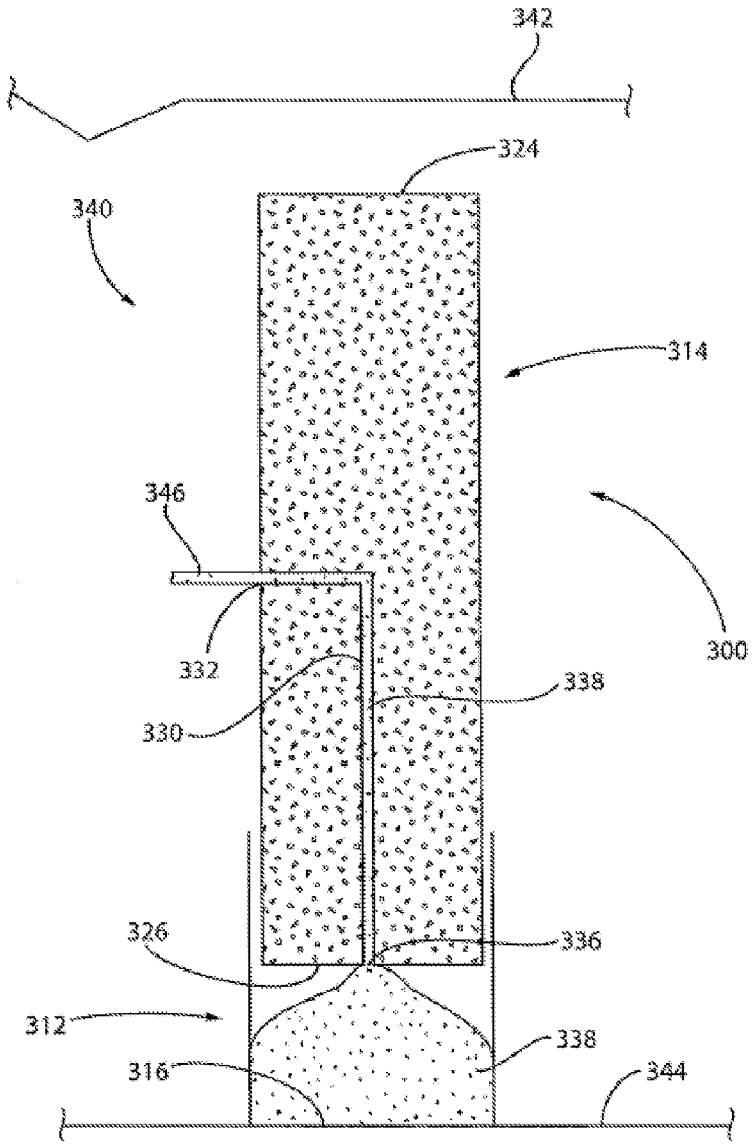
FIG. 9 is a cross-sectional view of the mine roof support of FIG. 8 in a partially installed state with respect to a mine.
Figure 10:
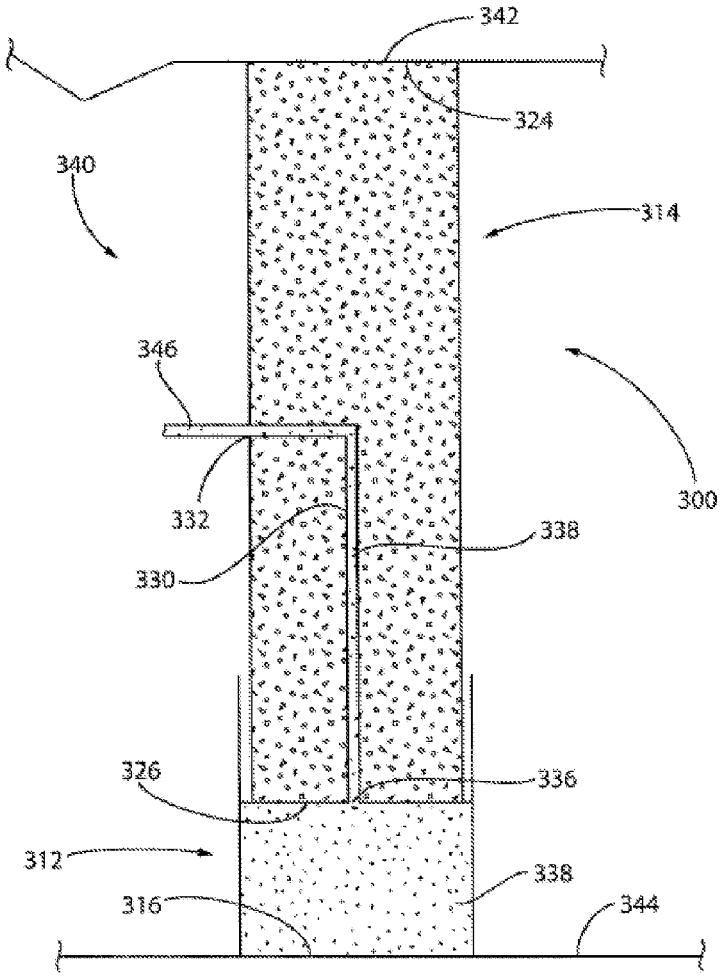
FIG. 10 is a cross-sectional view of the mine roof support of FIG. 8 in a fully installed state with respect to the mine.

Reference is now made to FIGS. 8-10, which show an extensible mine roof support 300 according to a third embodiment of the invention for use in a mine environment. The mine roof support 300 includes a container member 312 and a support member 314.

The container member 312 includes a bottom portion 316. A side portion 318 extends substantially upwardly from the bottom portion 316. The side portion 318 defines an opening 320 sized to accommodate at least a portion of the support member 314 therein. Desirably, the container member 312 is substantially cylindrical in shape, but may be embodied as other shapes. For example, the bottom portion 316 may be a substantially circular base and the side portion 318 may be a curved wall disposed along the outer edge of the circular base. It is to be understood that the container member 312 may be of unitary construction or may be a multiple piece construction. An exemplary height of the container member 312 is approximately three feet. Desirably, the container member 312 is constructed of relatively rigid or other suitable material including, but not limited to, steel. The bottom portion 316 of the container member 312 may be contoured or be adapted to correspond to a specific grade or grade variations on a mine floor.

For example, a substantially rectangular-shaped portion of sheet steel may be procured. Thereafter, that sheet steel portion may be machine-rolled, such that the most distal opposing ends thereof are brought together to form a loop, and, consequently, the side portion 318 of the container member 312. The opposing ends may then be welded together to form an air-tight weld seam. Then, a substantially round portion of sheet steel may be procured that substantially corresponds in diameter to that of the side portion 318, and is thereby designated as the bottom portion 316 of the container member 312. An air-tight weld seam is then created to secure the side portion 318 to the bottom portion 316. Accordingly, an exemplary embodiment of the container member 312 is constructed. It is to be understood that the aforementioned steps for constructing the container member 312 are for exemplary purposes only. Thus, one having ordinary skill in the art would understand that modifications and variations to the aforementioned construction steps may be necessary to construct other suitable container members having different shapes, dimensions, and/or materials.

In one desired embodiment, the support member 314 defines an enclosure having a body 322, with a top portion 324, and a bottom portion 326 disposed at respective distal ends of the body 322. Desirably, the support member 314 is substantially hollow to receive a filler 328 therein. Therefore, it is to be understood, that the support member 314 may include suitable openings or ports (not shown) for introducing the filler 328 into the support member 314. Alternatively, the support member 314 may be partially solid or entirely solid. A partially solid support member 314 may, therefore, accommodate less filler 328 than a substantially hollow support member 314. It is to be understood that the internal structure of the support member 314 may assume various configurations. Exemplary and non-limiting filler 328 includes foamed cement (such as FOAMCRETE®), concrete, polyurethane, or crushed mine tailings (i.e., discarded excavated mine material). In the desirable embodiment as shown in FIG. 8, the support member 314 includes a bore 330 defined therein. The bore 330 includes a first opening 332 defined along a side portion 334 of the support member 314 and a second opening 336 defined along the bottom portion 326 of the support member 314. As shown in FIGS. 9 and 10, the bore 330 is adapted to receive a material 338 therethrough. For example, the bore 330 may be a plastic pipe that is approximately ½ inch to one inch in diameter. The bore 330 may be routed through the filler 328 in any suitable configuration. Alternatively, the bore 330 may be situated within the side portion 318 of the container member 312.

Desirably, the shape of the support member 314 substantially corresponds to the shape of the container member 312. For example, both the container member 312 and the support member 314 are substantially cylindrical in shape, however, it is to be understood that the support member 314 may be embodied as other shapes. For example, with respect to a cylindrical shape, the top and bottom portions 324, 326 may be substantially circular bases. Desirably, an 8×8 foot piece of 16 gauge cold roll sheet steel may be curved, such that two opposing ends thereof are brought together to form the body 322 of the support member 314. Thereafter, the top and bottom portions 324, 326 are attached to the respective distal ends of the body 322. It is to be understood that the support member 314 may be of unitary construction or may be a multiple piece construction. Desirably, the support member 314 is constructed of relatively rigid or other suitable material including, but not limited to, steel. The top portion 324 of the support member 314 may be contoured or be adapted to correspond to a specific grade or grade variations of a mine roof.

The height of the support member 314 may be greater than the container member 312. For example, a desirable height of the support member 314 may be eight feet, as compared to the three feet height of the container member 312. Thus, when the support member 314 is inserted into the container member 312, the support member 314 extends beyond the opening 320 of the container member 312. In the exemplary use of an 8×8 foot piece of sheet steel, the body 322 of the support member 314 is approximately thirty inches in diameter. The diameter of the support member 314, or width along the widest portion thereof, is less than the diameter or width of the container member 312. Thus, in the case of a thirty-inch diameter body 322, the diameter of the container member 312 may be anything greater than thirty inches. Desirably, the variation in diameters differs only to the extent that there exists a minimal sufficient clearance between the side portion 318 and the side portion 334.

An operation of the mine roof support 300 in accordance with a desirable embodiment of the present invention will now be discussed. With continuing reference to FIG. 8, the mine roof support 300 is used in a mine 340 having a mine roof 342 and a mine floor 344, as shown in FIGS. 9 and 10. In the desirable embodiment, the container member 312 is positioned on the mine floor 344 below the mine roof 342. Thereafter, the support member 314 is inserted into the container member 312. A hose 346 or suitable equivalent may be attached to the first opening 332 of the bore 330. A pressurized machine (not shown) may be connected to the hose 346 and operated to introduce the material 338 into the bore 330. It is to be understood that any suitable machine configured to entrain solids into an air cavity may be utilized. For example, an air stream may be delivered into a container of the material 338 with an airstream exiting the container having the material 338 entrained therein. The material 338 is delivered through the bore 330 such that the material is deposited via the second opening 336 into the container member 312. Consequently, as more material 338 is deposited into the container member 312, the support member 314 is increasingly moved closer to the mine roof 342. Specifically, the support member 314 is upwardly displaced within the container member 312 by the material 338 pushing against the bottom portion 326. An exemplary amount of material 338 may be at least two feet. However, it is to be understood that the raised height of the support member 314 may vary based upon the distance of the void between the top portion 324 of the support member 314 and the mine roof 342. Other factors determining the raised height include, but are not limited to, the height of the container member 312, the type of material 338, and the amount of weight to be supported by the mine roof support 300. It has been determined that the support member 314 may be raised with a force corresponding to as little as 1.6 PSI and that raising thereof may be accomplished in approximately one second. Once the top portion 324 of the support member 314 contacts the mine roof 342, the weight of the mine roof 342 is distributed to and supported on the mine roof support 300. In the case of an uneven mine roof 342, wedges (not shown) may be introduced between the top portion 324 and the mine roof 342 to obtain a substantially even contact surface. However, it is to be understood, that the wedges are not intended to support the weight of the mine roof 342, as is the case in the prior art. After installation of the mine roof support 300, the hose 346 may be removed and the first opening 332 of the bore 330 may be sealed.

In an alternative embodiment of the present invention, the support member 314 may be raised substantially with air alone so that the material 338 is introduced into the container member 312 only after the support member 314 has been raised. It is also envisioned that the present invention may be modified to operate as a primarily hydraulic or pneumatic telescoping mine roof support. Accordingly, the material 338 may be substituted by water or air, respectively.

In some applications, it may be beneficial to provide the underside of the bottom portion 326 (facing the material 338) with patterning or other surface texturing. Surface texturing on the underside of the bottom portion 326 can enhance the filling and spreading of the material 338 entrained in air as the container member 312 is filled. The surface texturing may be formed in the material of the bottom portion 326 (in the steel) or may be applied as a separate layer, such as a layer of patterned or roughened foamed concrete.

It is to be understood that the mine roof support 300 may be assembled remotely or on-site or a combination thereof. For example, in the case of using mine tailings for the filler 328 of the support member 314, the mine roof support 300 may be constructed in an area relatively close to the mine 340, as that is where the mine tailings may be found. Filling the support member 314 on-site eliminates incurring costly and cumbersome heavy cargo accommodations that would ordinarily be necessary if each mine roof support 300 is pre-filled at a remote location.

It can be appreciated that all of the above disclosed supports can be designed for low confined spaces, or high expansive areas. Cylinder dimensions are not limited to one size, but will be sized to supply the proper support via multiple units in smaller diameters in specific patterns for the design support, and/or larger diameter units to stand alone for the proper area for the required design support.

The invention has been described with reference to the desirable embodiments. Modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A support for use in mines and other underground workings comprising:

at least two stacked cylindrical drums, each of said at least two stacked cylindrical drums including a top portion, a bottom portion, a cylindrical sidewall extending between the top portion and the bottom portion, and a load-bearing material therein;

each of the top portion and the bottom portion of each stacked cylindrical drum comprising a reinforcing chime;

an opening extending through the top portion of each stacked cylindrical drum for receiving the load-bearing material therethrough; and at least one securing member comprising a ring portion including a cross portion and an extending portion disposed around the circumference of the at least two cylindrical drums for securing the bottom portion of a first cylindrical drum to at least the top portion of a second cylindrical drum of the at least two stacked cylindrical drums, such that the reinforcing chime of the bottom portion of the first cylindrical drum is adjacent the reinforcing chime of the top portion of the second cylindrical drum with the extending portion of the at least one securing member positioned therebetween.

2. A support for use in mines and other underground workings comprising:

at least two cylindrical drums, each cylindrical drum comprising a top portion, a bottom portion, a cylindrical sidewall extending between said top portion and said bottom portion, and a load-bearing material therein;

an opening extending through the top portion of each cylindrical drum, said opening configured for receiving the load-bearing material therethrough;

each of the top portions and the bottom portions comprising a reinforcing chime;

at least one securing member comprising a ring portion disposed around the circumference of the at least two cylindrical drums for securing the bottom portion of a first cylindrical drum to at least the top portion of a second cylindrical drum of the at least two cylindrical drums, such that the reinforcing chime of the bottom portion of the first cylindrical drum is adjacent the reinforcing chime of the top portion of the second cylindrical drum; and at least two reinforcing members comprising cladding members disposed along an internal or external surface of at least one of said at least two cylindrical drums, said at least two reinforcing members associated with said at least two cylindrical drums for providing support to said at least two cylindrical drums, said at least two reinforcing members being spaced a distance apart with respect to said sidewall of at least one of said at least two cylindrical drums to define a controlled deflection zone of said sidewall, said controlled deflection zone being configured for controlled deflection of the sidewall upon an application of a load to said support and/or upon a shifting of said load-bearing material contained within said at least two cylindrical drums.

3. The support of claim 2, wherein said at least two cylindrical drums comprise a plurality of stackable cylindrical drums and said at least two reinforcing members comprise a plurality of reinforcing members.

4. The support of claim 3, wherein said plurality of stackable cylindrical drums comprise 55 gallon drums secured together by said plurality of reinforcing members, said plurality of reinforcing members comprising at least a top reinforcing member, a bottom reinforcing member, and a central reinforcing member located between adjacently stacked drums.

5. The support of claim 4, wherein said plurality of reinforcing members comprise cylindrical internal cladding members positioned at spaced locations adjacent an inner surface of said sidewall of at least one of said plurality of cylindrical drums.

6. The support of claim 5, wherein said cylindrical internal cladding members comprise sectioned cylindrical drums of equal structural strength.

7. The support of claim 2, wherein said support includes at least two controlled deflection zones, and wherein each controlled deflection zone is capable of deflecting up to 12 inches.

8. The support of claim 2, including a yield ring associated with the top portion of the first cylindrical drum.

9. The support of claim 8, wherein the yield ring comprises a plurality of separate load-bearing members banded together.

10. The support of claim 9, wherein said plurality of separate load-bearing members are sized for different mining heights and are capable of being filled to achieve a specified density.

11. The support of claim 8, including a load transfer plate positioned between the yield ring and the top portion of the first cylindrical drum.

12. A method of supporting a mine or other underground workings comprising:

providing at least two cylindrical drums, each cylindrical drum having a top portion, a bottom portion, a cylindrical sidewall extending between said top portion and said bottom portion, a load-bearing material therein, and a reinforcing chime associated with each of the top and the bottom portion, said top portion including an opening extending therethrough and being configured for receiving the load-bearing material therein; and associating at least two reinforcing members with said at least two cylindrical drums for providing support to said cylindrical drums, said at least two reinforcing members comprising cladding members disposed along an internal or external surface of at least one of said at least two cylindrical drums, said at least two reinforcing members being spaced a distance apart with respect to said sidewall of at least one of said at least two cylindrical drums to define a controlled deflection zone of said sidewall, said controlled deflection zone being configured for controlled deflection of the sidewall upon an application of a load to said support and/or upon a shifting of said load-bearing material contained within said at least two cylindrical drums;

wherein the controlled deflection zone is capable of deflecting up to 12 inches.

13. The method of claim 12, wherein said at least two cylindrical drums comprise a first drum and a second drum and said at least two reinforcing members comprise at least three reinforcing members formed by sectioning a drum to form a top reinforcing member, a bottom reinforcing member and a central reinforcing member, and wherein said reinforcing members are configured for use as internal cladding members positioned at spaced locations adjacent an inner surface of said first and second drums.

14. The method of claim 13, wherein said first and second drums are stacked adjacent to each other, and wherein said top reinforcing member is located at the top portion of said first drum, said bottom reinforcing member is located at the bottom portion of said second drum, and said central reinforcing member is located between the adjacently stacked drums.

15. The method of claim 12, including positioning a load transfer plate adjacent to the top portion of the first cylindrical drum and positioning a yield ring comprising a plurality of separate load-bearing members adjacent to the load transfer plate.

16. A support for use in mines and other underground workings comprising:

a first drum having a first top portion, a first bottom portion, a first sidewall extending therebetween and defining a first opening adapted to receive a load-bearing material therethrough, and the load-bearing material therein; each of the first top portion and the first bottom portion comprising a reinforcing chime; and a second drum secured to the first drum, the second drum having a second top portion, a second bottom portion, a second sidewall extending therebetween and defining a second opening adapted to receive the load-bearing material therethrough, and the load-bearing material therein, the second opening being in fluid communication with the first opening of the first drum, each of the second top portion and the second bottom portion comprising a reinforcing chime; and at least one securing member comprising a ring portion disposed around the circumference of the first drum and the second drum for securing the first bottom portion to at least the second top portion, such that the reinforcing chime of the first bottom portion adjacent the reinforcing chime of the second top portion;

wherein at least one drum of the first and second drums comprises a first controlled deflection zone configured for controlled deflection of the associated first or second sidewall upon an application of a load to the support or upon a shifting of the load-bearing material contained within the first or second drums; the controlled deflection zone comprising cladding members disposed along an internal or external surface of said at least one drum.

17. The support of claim 16, wherein the load-bearing material comprises a two-component, quick-setting grout material.

18. The support of claim 16, wherein the load-bearing material comprises a filling material selected from the group consisting of cement blends, rock dust, salt, sand, coal, rock waste, and any combination thereof.

* * * * *